United States Patent [19]

Otsuka et al.

[11] Patent Number: 4,684,849

[45] Date of Patent: Aug. 4, 1987

[54] METHOD FOR DRIVING A GAS DISCHARGE DISPLAY PANEL

[75] Inventors: Akira Otsuka, Zama; Tsutae Shinoda, Akashi; Kenji Horio, Kawasaki; Tsuyoshi Tanioka, Musashino, all of Japan

[73] Assignee: Fujitsu Limited, Kawasaki, Japan

[21] Appl. No.: 724,276

[22] Filed: Apr. 17, 1985

[30] Foreign Application Priority Data

Apr. 18, 1984 [JP] Japan ..... 59-076527

[51] Int. Cl.[4] ..... G09G 3/10; G09G 3/22

[52] U.S. Cl. ..... 315/169.4; 315/169.1; 315/169.2; 315/169.3; 340/772; 340/778

[58] Field of Search ..... 315/169.2, 169.3, 169.4, 315/169.1; 313/500; 340/772, 778

[56] References Cited

U.S. PATENT DOCUMENTS 4,027,196 5/1977 Criscimagna et al. ..... 346/778

4,591,847 5/1986 Criscimagna et al. ..... 340/778

*Primary Examiner*—David K. Moore

*Assistant Examiner*—Michael Razavi

*Attorney, Agent, or Firm*—Staas & Halsey

[57] ABSTRACT

A method of driving a gas discharge display panel having first and second arrays of parallel conductors disposed in spaced relationship on opposite sides of a gas filled panel and oriented at transverse angles to each other, the electrodes of each array being insulated from direct contact with the gas by a corresponding layer of dielectric material. Coordinate intersections of the electrodes of the two arrays define corresponding individual discharge sites. A write signal is applied to the electrodes of the first array, in line sequential manner, to fire all of the cells associated with each electrode; thereafter, an erase pulse is applied to that same electrode, which has the capability of erasing all of the cells; for those cells selected to be illuminated, erase signal cancelling pulses are applied selectively to the corresponding electrodes of the second array, of reduced amplitude relative to the erase signal but sufficient to inhibit the erase function and thus prevent termination of the discharge in the selected cells. In a rectangular such display panel in which the first array has far fewer electrodes than the second array, the use of cancelling signals of relatively low level voltages permits fabrication of a drive circuit using less expensive elements, such as transistors, having low breakdown voltages, contributing to a significant reduction in cost of the drive circuits for the panel.

21 Claims, 10 Drawing Figures

METHOD FOR DRIVING A GAS DISCHARGE DISPLAY PANEL

BACKGROUND OF THE INVENTION

The present invention relates to a method for driving a gas discharge display panel. More particularly, it relates to an improved method for driving an AC driven plasma display panel (hereinafter PDP) wherein a fired cell is erased, or extingished, by a cancelling signal having a low peak voltage value.

The most typical type of gas discharge display panel is a PDP, wherein arrays of parallel conductors, typically designated X-electrodes and Y-electrodes, are disposed on opposite sides of a gas filled panel and oriented at transverse angles to each other, forming a matrix type arrangement. The electrodes are insulated from direct contact with the gas by a layer of dielectric material. Individual discharge sites (cells) located at coordinate intersections on the panel defined by corresponding X- and Y-electrode pairs, are selectively fired by application of write signals to the respective electrodes, providing a potential across the cell which exceeds the firing potential for producing a gas discharge in each such cell. Alternating sustain pulse signals, of lower amplitude than the firing potential, are continuously applied to all the cells, and sustain discharges in the fired cells due to a wall potential, or wall charge, which develops on the panel surface of each cell undergoing discharge, and which is in additive voltage relationship to the sustain pulse signals applied to the cell. The light emitted from the selectively fired cells forms a desired display.

A fired cell is erased by applying thereto an erasing signal, comprising a pulse having the same peak voltage as that of the sustain signal but of much reduced time duration (i.e., a "narrow" pulse width), which neutralizes the wall charge; this prevents the subsequent discharge of the cell, since in the absence of the wall charge, or potential, the sustain voltage is insufficient, by itself, to maintain the discharge.

There are known various PDP drive systems and corresponding driving methods. In one known system, addressing a cell is performed by simultaneously inputting half-amplitude write (or erase) signal voltages to the associated X- and Y-electrodes. Such half-selection systems, however, require complicated drive systems for both the X- and the Y-electrodes and tend to produce misfirings. There are also known PDP drive systems and corresponding methods which do not adopt the half-selection techniques; however, such systems employ complicated driving circuits for performing the addressing function and various power sources, resulting in a significant cost increase for the driving circuit. In addition, the required operating voltages for the driving signals are rather high. For example, in one such system, the peak voltage values of the required write, sustain, and erase signals are 140 volts, 90 volts, and 90 volts, respectively. As a result, there has been a substantial effort made to both reduce the number of the required power sources and to lower the required peak voltage values of the driving signals, so as to reduce the cost of the driving circuits. Particularly, the reduction of the peak voltage of the signals allows the use of elements, such as transistors, having a relatively low breakdown voltage, resulting in a substantial cost reduction of the semiconductor integrated circuits which are used.

The advantages of the present invention may be made more apparent, by comparison to an example of a prior art PDP driving method employing signals having waveforms as are illustrated in the time charts of FIG. 1. The waveform of each of the signals is rectangular. Diagonal lines drawn in the rectangles represent that the signals are applied selectively. The voltage actually applied to a given cell $C_{ij}$ of a PDP is determined by the difference of the signals applied selectively to the associated electrodes, i.e., $X_i$-electrode and the $Y_j$-electrode, by external drive circuits. With reference to FIGS. 1(*a*) and 1(*c*), there are applied to the Y*j*-electrode of the PDP, a write signal 52 of approximately 140 V, an erase signal 53 of approximately 90 V having a narrow pulse width, and repetitive sustain signals 51 of approximately 90 V, all of the same polarity. In the foregoing and hereafter, reference to the "value" or "level" of the voltage of a (pulse) signal means, in every case, the peak voltage of the (pulse) signal. Further, in this prior art PDP driving method, there are applied to the $X_i$-electrode, as seen in FIG. 1(*b*), a write signal cancelling pulse 55 of approximately 90 V, a preparatory converting signal 56 of approximately 90 V, and a train of repetitive sustain signals 54 likewise of approximately 90 V. As more fully described in U.S. Pat. No. 3,771,016, Toba et al., issued Nov. 6, 1973 and assigned to the common assignee of the present invention, for erasing any given cell, the cell is addressed by a related pair of signals comprising a preparatory signal and a subsequent erase signal; writing or nonwriting (i.e., maintaining a cell in a current state) for any given cell is performed by applying simultaneously to the respective X- and Y-electrodes, a combination of a write signal and the absence or presence, respectively, of a write signal cancelling pulse.

More particularly, the operation of a cell by the pulse signals as above described is performed as follows, with reference to the time charts of FIG. 1(*a*) through 1(*f*). When a cell $C_{ij}$ is selected to be fired, (i.e., the write function), a write pulse 52 of 140 V is applied to the $Y_j$-electrode, as shown in FIG. 1(*a*) and no write signal cancelling pulse is applied to the $X_i$-electrode, i.e., the write signal cancelling pulse 55 shown by dotted lines in FIG. 1(*b*) is not applied. There results a cell potential 52 of 140 V as shown in FIG. 1(*c*), which is sufficient to fire the cell. The cell discharge thereafter is sustained by the subsequent, alternating sustain signals 51 and 54 until an erasing process is applied to the cell $C_{ij}$ for extinguishing the discharge. When the cell $C_{ij}$ is not to be fired, a write signal cancelling pulse 55 of 90 V (shown in dotted lines in FIG. 1(*b*)) is applied to the $X_i$-electrode, reducing the cell potential to 50 V (i.e., 140 V–90 V), shown by the dotted line 55' in FIG. 1(*c*), the cell potential 55' of 50 V thus being much lower than the firing voltage of any given cell $C_{ij}$.

For erasing the cell $C_{ij}$, once fired, a preparatory converting signal 56 of 90 V is applied in advance to the $X_i$-electrode, as shown in FIG. 1(*e*), which converts the polarity of the cell wall potential; thereafter, an erase signal 53 is applied to the $Y_j$-electrode as shown in FIG. 1(*d*), producing the cell potential shown in FIG. 1(*f*). As a result, the discharge in the cell extinguishes, thus erasing the prior discharge display at the cell.

In the prior driving method described above, drive systems for driving Y-electrodes and X-electrodes are required to output, selectively, pulse signals having a sequence of voltage levels of 90 V, 140 V and 90 V, respectively. The relatively high level of these voltages contributes to the corresponding, relatively high costs of the drive circuits since they must employ several transistors and other elements, all having high breakdown voltage characteristics. Further, because of various electrical and physical conditions and characteristics of the individual cells of a PDP, there is an inherent problem arising out of the differences in the gas discharge characteristics of the individual PDP cells, throughout the two dimensional array of cells of the PDP. For example, there are differences, from cell to cell, in the time delay between the application of a potential sufficient to fire a cell and the actual initiation of the cell discharge. On the other hand, there is typically only a very short delay interval, such as one microsecond, between the application of the appropriate signals to erase the gas discharge in a given cell and the termination of the discharge. A driving method utilizing these characteristics of the cells of a PDP is disclosed in Japanese Pat. No. SHO-49-38848 of Umeda and Toba, published Oct. 21, 1974; in accordance with that method, all of the cells located on a given row, or in a given column (and thus corresponding to all the cells on an X-electrode or Y-electrode, as disclosed herein) initially are fired simultaneously and, immediately thereafter, the cells which are not to be fired are erased selectively by appropriate erase signals. This method can serve to overcome the non-uniformity of the gas discharge characteristics of the cells of a PDP and thus increase the operating voltage margin for the respective signals.

SUMMARY OF THE INVENTION

It is an object of the present invention to provide an improved driving method and a low cost driving system for a plasma display panel.

It is another object of the present invention to provide a method and driving circuit for addressing cells of a PDP utilizing low voltage signal pulses, thus allowing the use of transistors and other elements having low breakdown voltage characteristics and reducing the cost of the driving circuit.

It is a further object of the present invention to provide an improved PDP driving method ensuring more stablized operation, and affording an increased operating voltage margin of the driving signals.

These and other objects and advantages are achieved by the improved driving method of the invention, in accordance with which all of the cells on a given row or column, for example, those associated with the Y-electrode, initially are fired simultaneously by applying a write signal to the Y-electrode; this prevents misfiring or failed firing. This step is followed by application of an erase signal to that same electrode, namely the Y-electrode in this example; in time coincidence with the erase signal applied to the Y-electrode, cancelling pulses are applied to the X-electrodes associated with cells selected to be illuminated which reduces the effective erase signal voltage applied to the selected cells and effectively inhibits the erase function, such that the cell potential established in each cell selected to be illuminated is sufficient to cause the discharges to continue. With respect to cells which are not selected to be illuminated and thus in which the initial discharge must be extinguished, no cancelling pulse is applied to the associated X-electrodes; as a result, the full value of the erase signal applied to the Y-electrodes associated with those non-selected cells is effective and results in extinguishing the initial discharges created in these non-selected cells. Thus, only the cells selected to be illuminated, out of those initially placed into discharge by the write signal applied to the Y-electrode commonly associated therewith, remain in discharge, as a result of the erase signal cancelling pulse applied to the X-electrodes associated with those cells not selected to be illuminated, and the required pattern is thus displayed on the PDP.

Essentially, the gas discharge of a cell is maintained as long as the actual discharge voltage developed at, or across, the cell exceeds the minimum gas discharge firing voltage. Accordingly, the erasing signal at the selected cells need not be cancelled entirely—that is, the cell potential need not be reduced to 0 V—to inhibit the erase function and permit continuation of discharges in those cells selected to be illuminated. More particularly, the actual discharge voltage developed across a cell, i.e., the cell potential, is the sum of the wall potential and the applied voltage. Therefore, if the peak value of an erase signal is decreased to a certain value, the wall potential, or charge, is not fully neutralized, or cancelled, and thus some residual wall charge remains. The remaining charge induces a residual potential or voltage at each such cell which adds to the subsequent sustain signal applied to the cell, because the residual voltage and the sustain signal have the same polarity. As long as the sum of both voltages exceeds the minimum firing voltage required to produce a gas discharge in the concerned cell, the cell is fired and the erase signal applied to the Y-electrode fails to erase the cell. Therefore, the peak voltage of the erase signal cancelling pulse can be selected to be of a lower value than the erase signal, and, for example, may be 30 V. This allows the X-electrode drive circuit to comprise low breakdown voltage transistors, resulting in a significant cost reduction. These objects and advantages, which will be substantially apparent, reside in the details of construction and operation as more fully hereinafter described and claimed, with reference to the accompanying drawings. Throughout the figures, like reference numerals are used for like parts.

DESCRIPTION OF THE PREFERRED EMBODIMENTS

Figure 1:
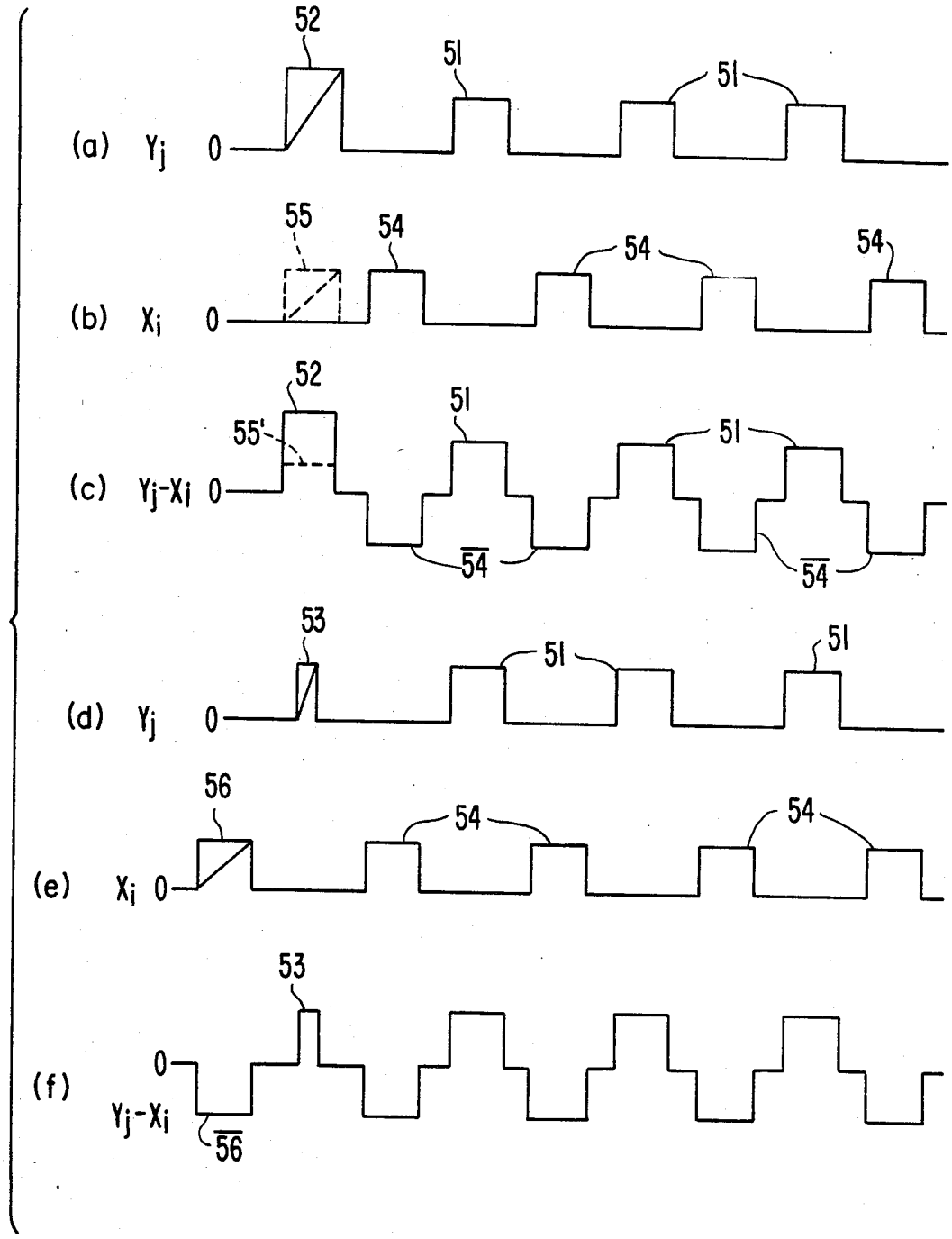
FIG. 1. (PRIOR ART)
FIGS. 1(*a*) to 1(*f*) comprise time charts illustrating waveforms of pulse signals utilized in a prior art PDP driving method.
Figure 2:
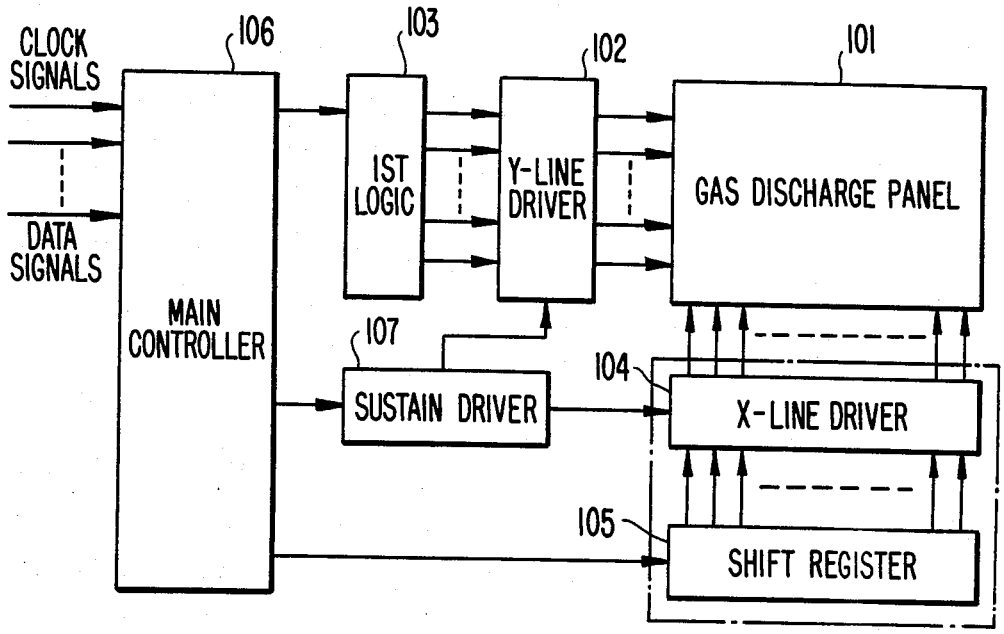
FIG. 2 is a block diagram of a PDP driving system in accordance with the present invention.

FIG. 2 is a block diagram of a PDP driving system in accordance with an embodiment of the present invention, for illustrating the implementation of a driving method for a PDP in accordance with the invention. An AC type plasma display panel (PDP) 101 has corresponding groups of X-electrodes and Y-electrodes in a matrix arrangement. In FIG. 2, the Y-electrodes are driven by a Y-line driver 102, the line selection of which is controlled by a large scale integrated (LSI) logic circuit 103, which performs line sequential addressing. Main controller 106 receives a clock signal and data signals defining the information to be displayed, and processes same to produce control signals which are supplied to the LSI logic circuit 103. A shift register 105 receives control signals from the main controller 106 and supplies control signals to an X-driver 104 for driving the X-electrodes of the PDP. A sustain driver 107 receives control signals from the main controller 106 and provides sustain signals to the X-electrodes. The X-line driver 104 and the shift register 105, shown surrounded by a dot-dash line rectangle, are floated potentially to the output of the sustain driver 107.

Figure 3:
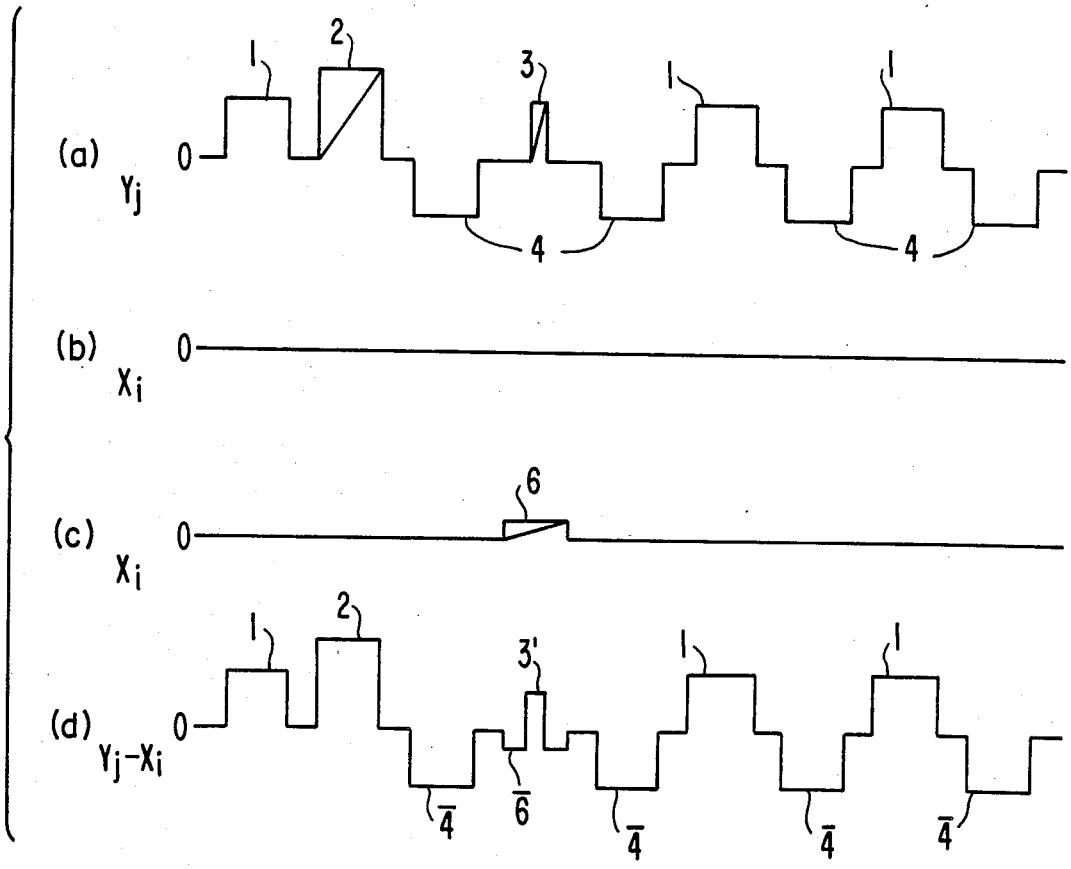
FIGS. 3(*a*) to 3(*d*) comprise time charts illustrating waveforms of pulse signals utilized in a PDP driving method in accordance with a first embodiment of the present invention.

The first embodiment of the improved PDP driving method of the invention is shown in the time charts of FIG. 3. In accordance with line sequential addressing, the Y-electrodes are selected sequentially from the top electrode. When a $Y_j$-electrode is selected, as shown in FIG. 3(*a*), a write signal 2, of one polarity and of approximately 140 V, is applied to the $Y_j$-electrode to fire all the cells located on the $Y_j$-electrode simultaneously. As is typical, the write signal 2 is timed such that a sustain signal 1 having the same polarity as that of the write signal 2 precedes the write signal 2. This is done because the preceding sustain signal 1 stabilizes the wall potential of the PDP cells and ensures proper functioning of the cells in response to the following signal—in this case, the write signal 2. There next is applied a sustain signal 4 of 90 V and of the opposite polarity to the write signal 2, which acts as a converting signal, as described above, and maintains the gas discharge of the cell. This is followed by an erase signal 3, of narrow pulse width. The erase signal 3 is followed by a series of alternating sustain signals 1 and sustain signals 4, of opposite polarities to each other, which sustain the discharges in the fired cells.

When a given cell $C_{ij}$ is not selected to be illuminated, no signal is applied to the $X_i$-electrode, as shown in FIG. 3(*b*). As a result, the cell potential has the same waveform as the signal on the $Yi$-electrode, as is shown in FIG. 3(*a*). Thus, the erase signal 3 produces a cell potential of 90 V, and, since preceded by a sustain signal 4 also of 90 V but of the opposite polarity and which therefore induces a corresponding opposite polarity wall potential, erases the cell $C_{ij}$ as described before. When the cell $C_{ij}$ is to be illuminated, a cancelling signal 6 for the erase signal 3 is applied to the cell through the $X_i$-electrode in time coincidence with the erase signal 3, as shown in FIG. 3(*c*). The waveform of the cell potential then is as shown in FIG. 3(*d*). As a result, the erase cell potential 3', the peak voltage of which is reduced to approximately 60 V from the 90 V level of erase pulse 3, is insufficient to produce the erasing function and thus fails to erase the cell $C_{ij}$. Thus, the line/cell addressing function for cells on the selected $Y_j$-electrode is completed, and the individual cells of that line are selectively illuminated or non-illuminated, as required.

As noted, the peak voltage of the erase pulse cancelling pulses 6 can be as low as approximately 30 V. The selection of X-electrodes is performed by the X-line driver 104 shown in FIG. 2. Most of addressing operation is performed by the circuits associated wth X-electrodes, requiring a somewhat complex implementation. However, since the cancelling pulses 6 are low level, the transistors used in the associated circuits for driving the X-electrodes may have low breakdown voltages, resulting in a considerable cost reduction of the circuit in spite of its complexity. Particularly, for a rectangular type PDP, having a relatively small number of Y-electrodes and a large number of X-electrodes, a significant cost reduction can be achieved. In addition, since cancelling pulses for write singals are not required, the drive circuits are grealy simplified. Although relatively high breakdown voltages are required for the associated circuits for driving the Y-electrodes, the circuits are rather simple because they need only supply repetitive, predetermined cycles of drive signals and thus no addressing circuits are required. Furthermore, with most ordinary rectangular PDP types, the number of the Y-electrodes is small, thus minimizing costs for the Y-electrode drive circuits. As a result, a significant total cost reduction for a system to implement the PDP driving method in accordance with this first embodiment of the invention readily can be achieved.

Figure 4:
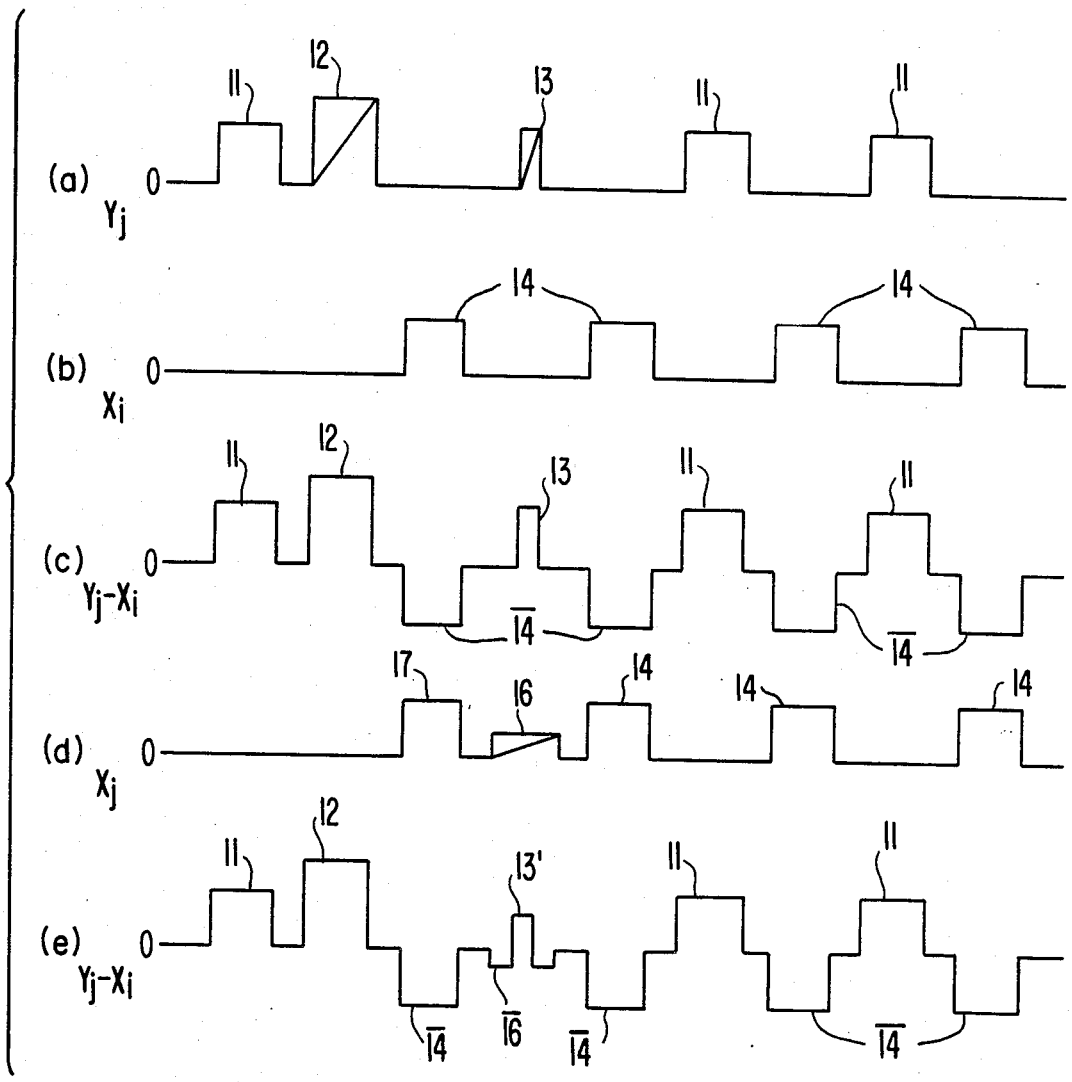
FIGS. 4(*a*) to 4(*e*) comprise time charts illustrating waveforms of pulse signals utilized in a PDP driving method in accordance with a second embodiment of the present invention.

A PDP driving method in accordance with a second embodiment of the invention is illustrated in accordance with the pulse signal time charts of FIG. 4 and will be seen to be a modification of the first embodiment, described above in relation to FIG. 3. Unlike the first embodiment, sustain signals 11 and 14 of the same polarity are applied respectively to the $Y_j$-elecrodes and $X_i$-electrodes. A write signal 12, an erase signal 13, and a cancelling signal 16 are applied in the same way as the respectively corresponding write signal 2, erase signal 3, and cancelling signal 6 are applied in the case of the first embodiment. Thus, with reference to FIG. 4(*a*), a write signal 12, an erase signal 13, and sustain signals 11 are applied to a selected $Y_j$-electrode. With respect to a cell $C_{ij}$ located on the $Y_j$-electrode which is not to be illuminated, there are applied only the sustain signals 14 of the $X_i$-electrode, as shown in FIG. 4(*b*). The resulting cell potential waveform is as shown in FIG. 4(*c*). Conversely, when a given cell $C_{ij}$ is to be illuminated, a cancelling signal 16, preceded by a sustain signal 17 which acts as a converting signal, is applied to the $X_i$-electrode as shown in FIG. 4(*d*) the resulting cell potential is shown in FIG. 4(*e*), which will be seen to be the same as the cell potential waveform shown in FIG. 3(*d*), and particularly the erase cell potential shown at 3' in FIG. 3(*d*) is identical in FIG. 4(*e*) as 13'. To protect the X-line driver 104 and the shift register 105 from the relatively high voltage of the sustain signals of 90 V, a floating potential connection to the sustain driver 107 is employed, as illustrated by the surrounding dot-dash line rectangle in FIG. 2.

Figure 5:
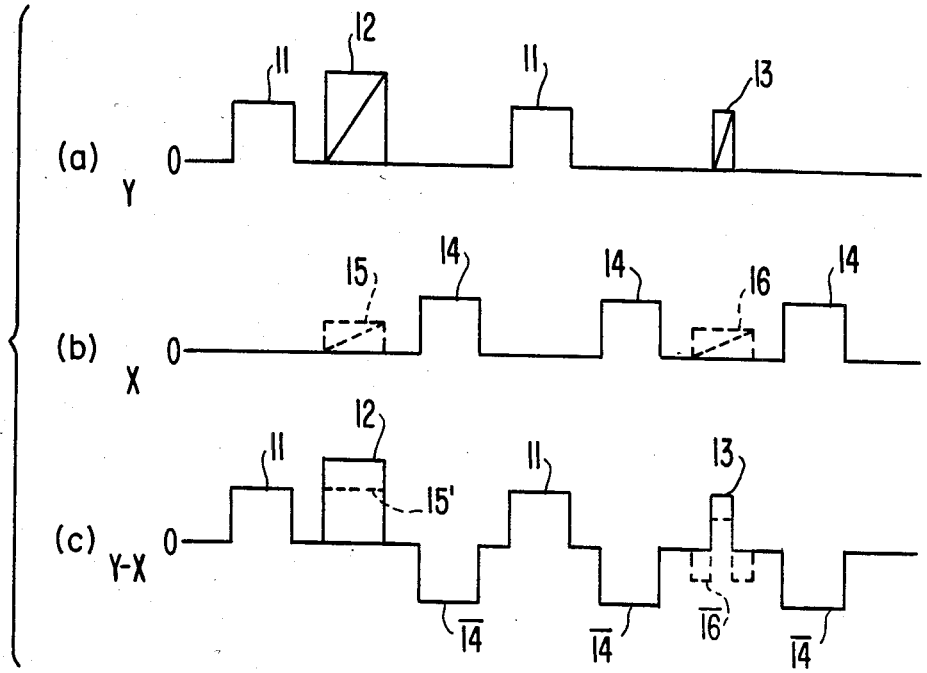
FIGS. 5(*a*) to 5(*c*) comprise time charts illustrating waveforms of pulse signals utilized in a PDP driving method in accordance with a third embodiment of the present invention.

A PDP driving operation in accordance with a third embodiment of the present invention is performed in accordance with, and is described in relation to, the time charts of the applied operating signals of FIG. 5. The third embodiment is adaptable to more general use, typically employing line sequential addressing techniques for directly addressing a selected cell $C_{ij}$. With reference to the system block diagram of FIG. 2 and the signal pulse waveform of FIG. 5(*a*), the Y-line driver 102 applies to the Y-electrodes, sustain signals 11 of approximately 90 V, erase signals 13 of approximately 90 V and having a narrow pulse width, and a write signal 12 of approximately 140 V. Likewise, the X-line driver 104 applies to the X-electrodes, as shown in FIG. 5(*b*), sustain signals 14 of 90 V and, selectively, a write signal cancelling pulse 15 or an erase signal cancellng signal 16 (both cancelling signals being shown in dotted lines). The resulting cell potentials produced by the signals applied to the $X_i$- and $Y_j$-electrodes are shown in FIG. 5(*c*). As stated before, complete cancellation or neutralization of the write and the erase signals is not necessary. Accordingly, the peak voltage of the cancelling signals can be less than two-thirds of that of the sustain signals. In this case, the cancelling (pulse) signals, both for the write and the erase signals, are of 50 V.

Figure 6:
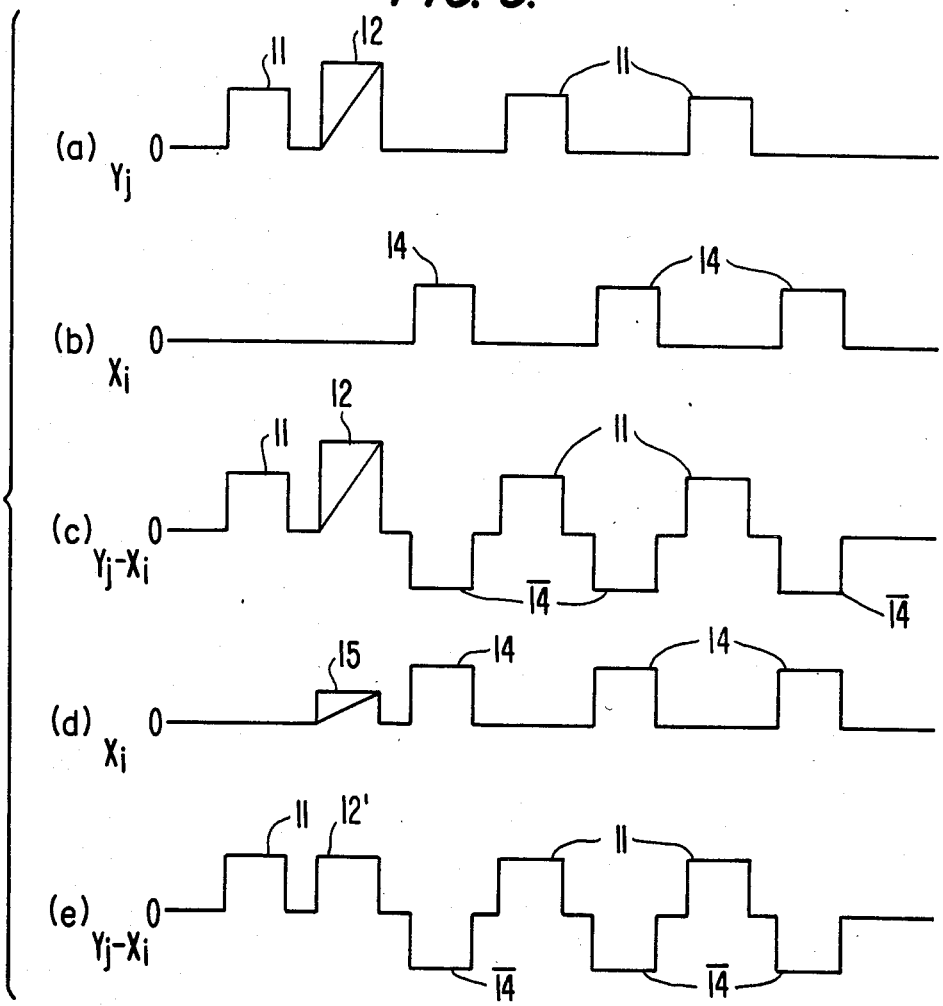
FIGS. 6(*a*) to 6(*e*) comprise time charts illustrating waveforms of pulse signals utilized to perform a write operation in accordance with the third embodiment of the present invention.

When a write operation is performed with respect to cells located on a selected $Y_j$-electrode, a write signal 12 and sustain signals 11 are applied to the $Y_i$-electrode, as shown in FIG. 6(*a*). Simultaneously, sustain signals 14, only, are applied to the X-electrodes associated with the cells to be illuminated, as shown in FIG. 6(*b*), producing a cell potential waveform shown in FIG. 6(*c*). The cells are fired by the resultant write signal cell potential 12 of 140 V. With respect to the cells not to be illuminated, as shown in FIG. 6(*d*), cancelling signals 15 of 50 V are applied to the associated X-electrodes in time coincidence with the write signals 12 of FIG. 6(*a*), resulting in the cell potentials of the corresponding cells having the waveform as shown in FIG. 6(*e*). The write signal 12 of 140 V is reduced by the cancelling signal 15 of 50 volts to produce approximately a 90 V cell potential as shown at 12' in FIG. 6(*e*), which thus inhibits the write function. Whereas it is generally well known to inhibit the write function by a cancelling pulse of 90 V, usually equal to the sustain voltage pulse level, it is significant that in accordance with the present invention, the voltage level of the cancelling signal 15 can be relatively lower than that of the sustain signals 11 and 14—for example, 50 V.

Figure 7:
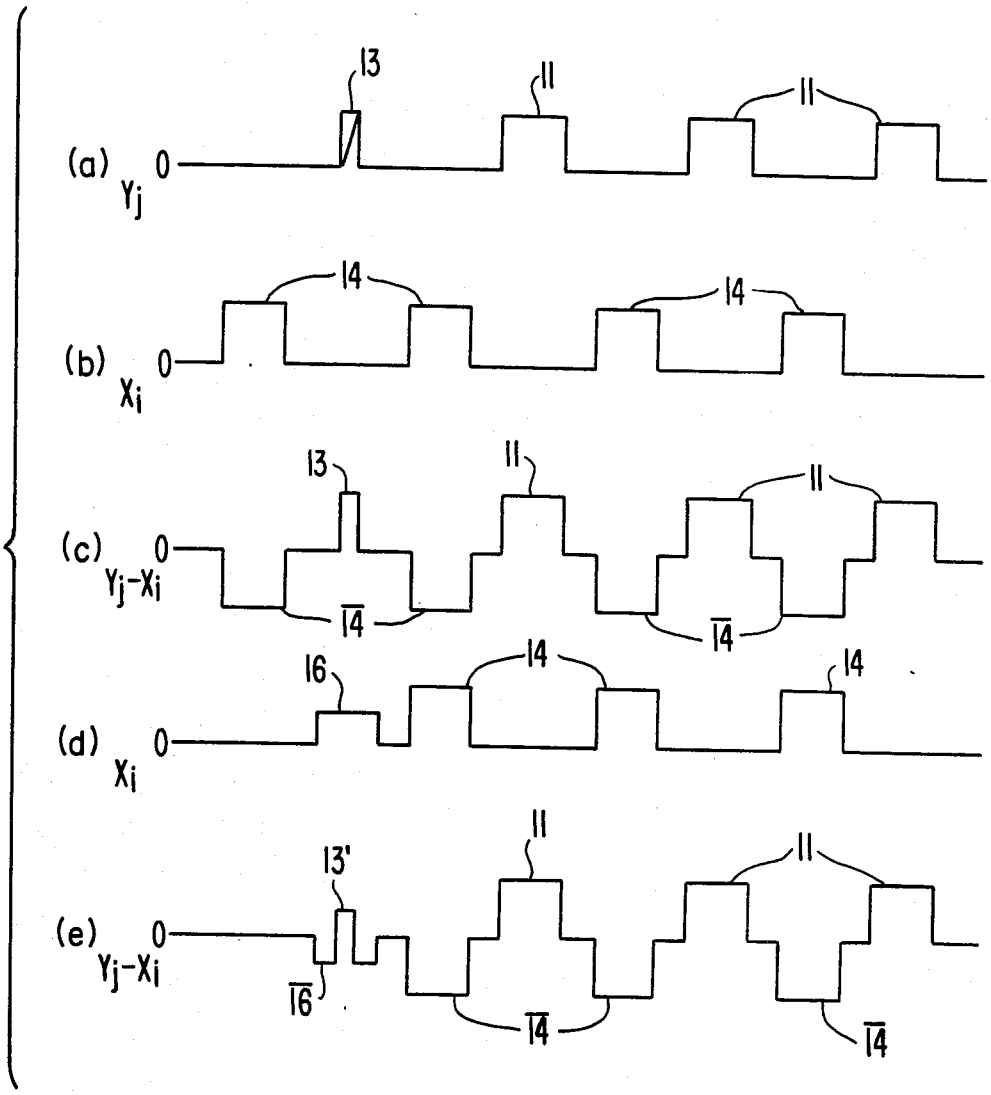
FIGS. 7(*a*) to 7(*e*) comprise time charts illustrating waveforms of pulse signals utilized to perform erase operations in accordance with the third embodiment of the present invention.

For selectively erasing currently fired cells, an erase signal 13 is applied to the Y-electrode of each such cell which is then followed by the succession of sustain pulse signals 11, as shown in FIG. 7(*a*) for electrode $Y_i$. Concurrently therewith, there are applied to the X-electrodes associated with the cells to be erased, only the sustain signals 14, as shown in FIG. 7(*b*) for electrode $X_i$, at least one of which signals 14 must precede the erase signal 13 applied to the $Y_j$-electrode, as seen in comparison of FIGS. 7(*a*) and 7(*b*). The resulting cell potentials are shown in FIG. 7(*c*), pursuant to which the associated, currently firing cell $C_{ij}$ is erased. This is performed simultaneously for all cells on the selected $Y_i$ electrode, and thus in parallel for all the X-electrodes. Conversely, for cells associated with the $Y_i$ electrode which are not to be erased, there are additionally applied to the corresponding X-electrodes, as shown for electrode $X_i$ in FIG. 7(*d*), cancelling signals 16 of approximately 50 V which coincide in time with the erase signal 13 applied to the $Y_j$-electrode, and shown in FIG. 7(*a*). The resulting cell potential of the cells not to be erased then is as shown in FIG. 7(*e*). Particularly, the cell potential 13' shown in FIG. 7(*e*) is of approximately 40 V which is insufficient to perform the erase function at the associated $C_{ij}$ cells. Thus, the cells on a given $Y_j$-electrode are selectively erased whereas the erase function is disabled, or inhibited, for those cells which are to remain firing.

As described above, the peak voltages of the cancelling pulses 15 and 16 for the erase signals and the write signals, respectively, may be relatively low, approximately 50 V in this case. Therefore, if the circuit for generating the cancelling pulses for the erase signals or the write signals potentially is floated to the sustain driver 107, the breakdown voltage of the circuit elements likewise may be low. This facilitates the fabrication of the circuit and reduces the fabrication cost.

Figure 8:
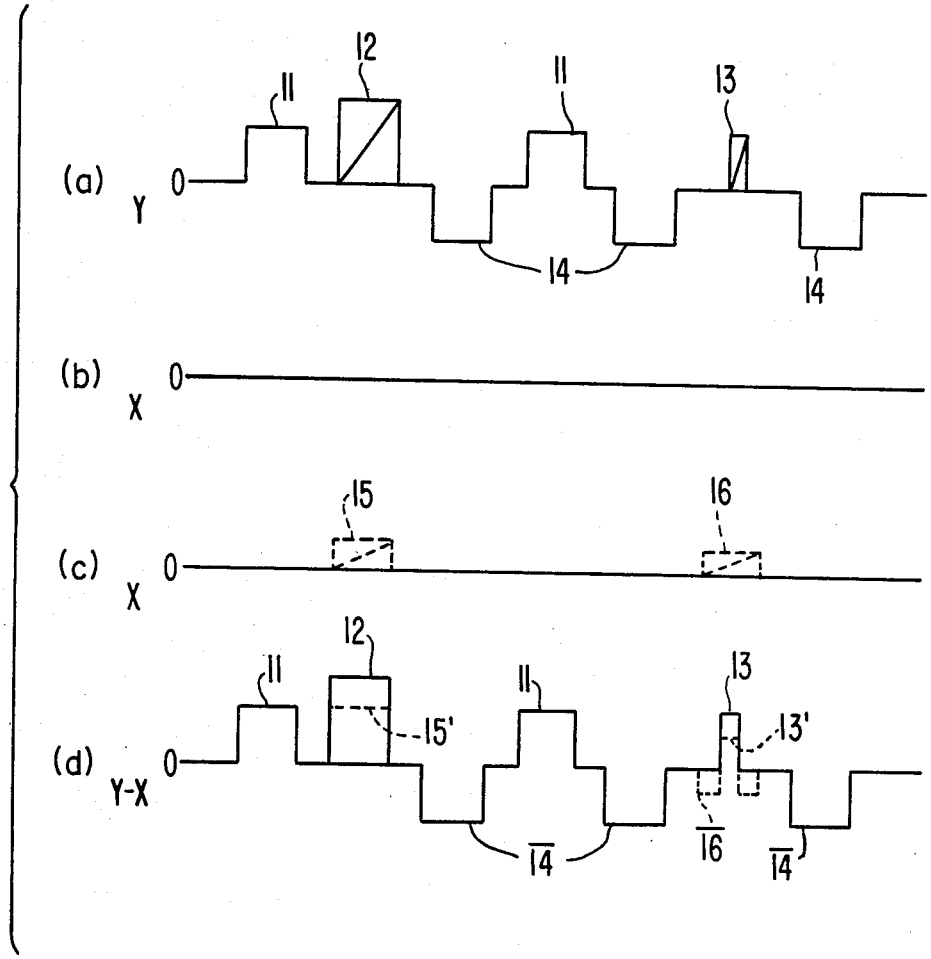
FIGS. 8(*a*) to 8(*d*) comprise time charts illustrating waveforms of pulse signals utilized in a PDP driving method in accordance with a modification of the above-mentioned third embodiment of the present invention.

A modification of the PDP driving method of the third embodiment of the invention as described above is illustrated in the time charts of FIG. 8, which correspond generally to those of FIG. 5 but wherein alternating polarity sustain pulse signals are commonly applied to the Y-electrodes, as in the case of FIG. 3(a). Particularly, FIG. 8(*a*) illustrates a time chart of the signals applied to a Y-electrode, comprising a write signal 12, an erase signal 13, and sustain signals 11 and 14 of opposite polarity. FIG. 8(*b*) is a time chart relating to the X-electrode, showing that no signals are applied thereto when either selective writing or erasing, in accordance with the respective signals 12 and 13 on the Y-electrode, is to be performed. FIG. 8(*c*) is a time chart illustrating the cancelling signals 15 and 16 which are selectively applied to an X-electrode associated with a given cell for cancelling the write signal 12 or the erase signal 13, respectively, applied to the corresponding Y-electrode as shown in FIG. 8(*a*), and FIG. 8(*d*) is a timing chart showing the resulting cell potentials. In FIG. 8(*d*), the dotted lines 15' and 13' correspond to the cell wall potentials resulting from the application of the cancelling signals 15 and 16, respectively, of FIG. 8(*c*).

As contrasted to the third embodiment wherein sustain signals 11 and 14 of common polarity are applied, respectively, to the Y- and X-electrodes as shown in FIGS. 5(*a*) and 5(*b*), in the present modification thereof, sustain signals 11 and 14 of opposite polarity are both applied to a given Y-electrode, as shown in FIG. 8(*a*). This modificaion thus requires two power sources respectively of positive and negative polarities for producing the sustain signals; the disadvantage of requiring the two power sources, however, is compensated by the advantages that there need only be applied to the X-electrodes, the cancelling signal 15 for the corresponding write signal 12 and the cancelling signal 16 for the corresponding erase signal 13 and, moreover, that both thereof may be of a low voltage level. As a result, even though a somewhat complex, selective addressing circuit must be provided for the X-electrodes, transistors and other elements of low breakdown voltage may be used. This contributes significantly to reducting the cost of the addressing circuit.

The measure of stability, or reliability, of a given PDP driving method is represented, or characterized, by its "voltage margin." More particularly, the "voltage margin" is a range within which the voltage level of either the write signal or the sustain signal, as applied for driving the PDP, may vary and still produce the desired display operations—i.e., there is neither misfiring nor failure of firing of any cells. As before noted, the inherent variations or differences in the characteristics of individual cells throughout a given PDP affects the voltage margin; however, at least to some degree, the effective voltage margin of a given PDP can be improved by the drive circuits. Usually, the voltage margin for the sustain signal is critical with respect to the method of driving a PDP. Thus, a well designed drive circuit can accommodate, or compensate for, certain unstable characteristics of the panel.

Figure 9:
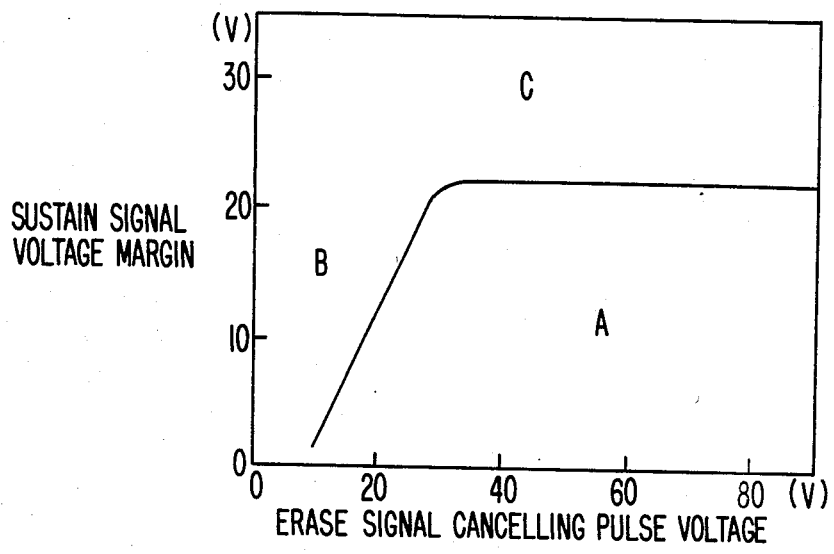
FIG. 9 comprises a voltage plot for illustrating the relationship of operating voltage margin to the voltage level of an erase signal cancelling pulse.
Figure 10:
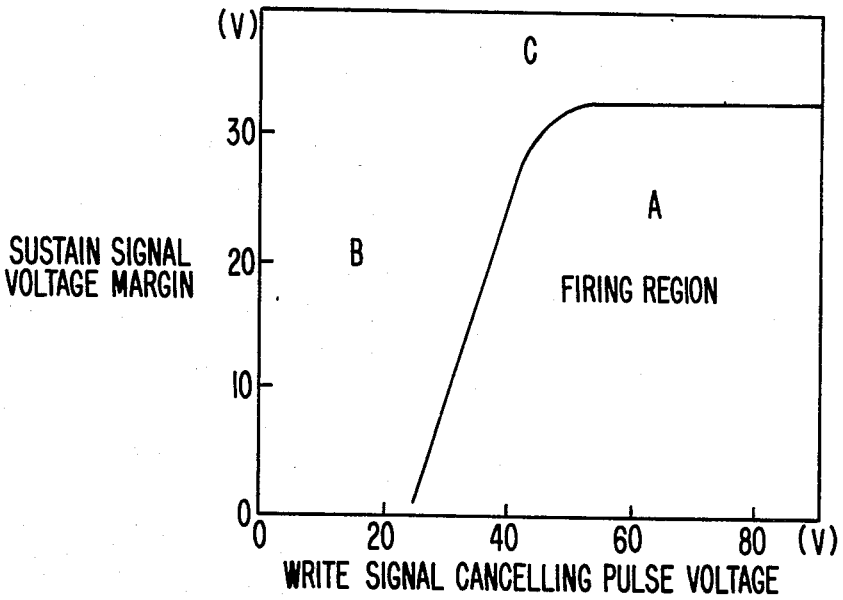
FIG. 10 comprises a voltage plot for illustrating the relationship of operating voltage margin to the voltage level of of the write signal cancelling pulse.

By way of example, and with reference to the above-described third embodiment, it is desirable that the voltage level of the cancelling pulses for the erase signals and the write signals be as low as possible. On the other hand, too low a value of the cancelling pulses may result in an unstable condition. For example, if the voltage level of the erase signal cancelling pulse is too low, a relatively high erase signal cell potential will be produced at the cell in question, which may be sufficient to produce the erase function even though the cell was intended to remain discharging. Thus, the voltage margin associated with a given PDP driving method will decrease as the voltage level of the erase signal cancelling pulse is reduced. FIG. 9 comprises a voltage plot which illustrates the relationship between the erase signal cancelling pulse voltage amplitude and the voltage margin, the former being plotted on the abscissa and the latter on the ordinate. When the combination of the erase signal and its corresponding cancelling pulse voltage fall within the region designated A in FIG. 9, the erasing operation is performed reliably. On the other hand, in the region B, the voltage level of the cancelling pulse is inadequate and thus its function of preventing the erase pulse from being effective for erasing a cell is not performed reliably, causing unstable operation. In the region C, on the other hand, the operation of the panel is unstable due to factors other than the voltage level of the cancelling pulse. Thus, from FIG. 9, the voltage level of the erase signal cancelling pulse may be selected as approximately 30 V, for maintaining a reasonable operating voltage margin in driving the PDP. FIG. 10 is a voltage plot similar to that of FIG. 9 but wherein there is shown the relationship between the write signal cancelling pulse and the voltage margin. By similar analysis, FIG. 10 illustrates that a write signal cancelling pulse having a voltage level of 50 V is sufficient for maintaining stable system operation. For this embodiment and with reference to FIGS. 9 and 10, therefore, an erase signal cancelling pulse of 30 V and a write signal cancelling pulse of 50 V affords a sufficient voltage margin for successful and reliable operation of the PDP driving system.

Whereas, in the foregoing specific description, specific voltage values for various of the driving signals such as the write signals, sustain signals, erase signals, and cancelling signals have been set forth, it will be obvious to those of skill in the art that the present invention is not restricted to nor confined by those specific voltage values and they are given for illustrative purposes only. Moreover, numerous modifications and adaptations of the driving method of the present invention will be apparent to those of skill in the art and thus it is intended by the appended claims to cover all such modifications and adaptations as fall within the true spirit and scope of the invention.

We claim:

1. A method for driving a gas discharge display panel having first and second arrays of parallel electrodes disposed on opposite sides of said panel and covered by corresponding first and second layers of dielectric material with a discharge gap therebetween filled with a discharge gas, said first and second electrode arrays being transversely oriented and the coordinate intersections thereof defining individual discharge cells, comprising:

applying a write signal of a first peak voltage level sufficient to produce a discharge in a cell, to at least a selected one of said electrodes of said first array, for producing a discharge in each of the cells associated with said selected, first array electrode;

applying an erase signal to said selected, first array electrode, following the application of said write signal thereto , the erase signal being of a second peak voltage level capable of terminating the said discharges in the said cells associated with said first array electrode;

applying selectively and simultaneously, and in time coincidence with the application of the erase signal to said selected first array electrode, an erase signal cancelling pulse to each of said electrodes of said second array corresponding to cells associated with said selected first array electrode in which a discharge is to be maintained, the voltage level of said cancelling pulse being substantially less than said second voltage level but sufficient to inhibit termination of discharges by the erase signal; and applying sustain signals to all of said cells thereby to maintain said discharges in said selected cells.

2. A method as recited in claim 1 wherein said sustain signals comprise sustain pulses of approximately said second peak voltage level and the voltage level of each said erase signal cancelling pulse is less than one-half of the said second peak voltage level.

3. A method as recited in claim 1 wherein the step of applying sustain signals to all of said cells comprises applying successive, alternating polarity sustain signal pulses to all of said cells.

4. A method as recited in claim 3 wherein the step of applying alternating polarity sustain signal pulses comprises applying the sustain signal pulses of a first polarity common to that of said write and erase signals to said first array of parallel electrodes and applying the sustain signal pulses of the opposite polarity to said second array of parallel electrodes.

5. A method as recited in claim 1 wherein said sustain signals comprise repetitive sustain pulses, further comprising:

applying at least a first sustain signal pulse to each said selected first array electrode following application of a write signal thereto and prior to application of an erase signal thereto;

applying, selectively and simultaneously, and in time coincidence with the application of the write signal to said selected first array electrode, a write signal cancelling pulse to each of said electrodes of said second array corresponding to cells associated with said selected first array electrode in which a discharge is not to be maintained, the voltage level of the write signal cancelling pulse being substantially less than said second voltage level but sufficient to inhibit producing a discharge in the said cells.

6. A method as recited in claim 5 wherein the voltage level of said write signal cancelling pulse is the same as the voltage level of said erase signal cancelling pulse.

7. A method as recited in claim 5 wherein said sustain signal pulses are of approximately said second peak voltage level.

8. A method as recited in claim 6 wherein said erase signal cancelling pulse and said write signal cancelling pulses are of a common voltage level, substantially less than the said second peak voltage level.

9. A method as recited in claim 8 wherein said erase signal cancelling pulse and said write signal cancelling pulses are of a common voltage level less than one-half that of said second peak voltage level.

10. A method as recited in claim 1 wherein said sustain signals comprise repetitive and sequential sustain pulses of alternating polarity, further comprising applying said first sustain signal pulse in common polarity with said write signal applied to each said selected first array electrode.

11. A method as recited in claim 10 further comprising applying said repetitive sustain signal pulses of opposite polarity to said first array electrode, said write signal being applied intermediate in time the occurrence of two successive sustain pulses of opposite polarity.

12. A method as recited in claim 11 further comprising applying the sustain signal pulses of a first polarity common to that of said write signal to said first array electrode and applying the sustain signal pulses of the opposite polarity in common to the second array electrodes.

13. A method as recited in claim 1 further comprising:

applying, in line sequential manner with respect to all of said electrodes of said first array, a write signal and an erase signal to each said first array electrode in which a discharge is to be produced in at least one selected cell associated therewith, and applying erase signal cancelling pulses to each of said second array electrodes associated with selected cells in which discharges are to be maintained, in time coincidence with the erase signal as applied, sequentially, to the corresponding said first array electrodes with which said selected cells are associated.

14. A method as recited in claim 2, further comprising:

applying an erase signal of said second peak voltage level as a narrow width pulse capable of terminating the said discharges in the said cells associated with said first array electrode; and applying each said erase signal cancelling pulse, having said voltage level substantially less than said second voltage level, as a pulse of substantially greater pulse width than said erase signal pulse width.

15. A method as recited in claim 14, wherein said pulse width of said erase signal cancelling pulse is substantially the same as the pulse width of each of said write and sustain signals.

16. A method as recited in claim 15, wherein the voltage level of each said erase signal cancelling pulse is no greater than one-third of the voltage level of the sustain signal pulses.

17. A method for driving a gas discharge display panel having first and second arrays of parallel electrodes disposed on opposite sides of said panel and covered by corresponding first and second layers of dielectric material with a discharge gap therebetween filled with a discharge gas, said first and second electrode arrays being transversely oriented and the coordinate intersections thereof defining individual discharge cells, comprising:

applying a write signal of a first peak voltage level sufficient to produce a discharge in a cell, to at least a selected one of said electrodes of said first array, for producing a discharge in each of the cells associated with said selected, first array electrode;

applying an erase signal to a selected, first array electrode in which a discharge in at least one cell associated with said selected first array electrode is to be extinguished;

applying, selectively and simultaneously and in time coincidence with the application of said write signal to each said selected one said electrodes of said first array, a write signal cancelling pulse to each of said electrodes of said second array corresponding to cells associated with selected first array electrode in which a discharge is not to be produced;

applying, selectively and simultaneously and in time coincidence with the application of an erase signal to said selected first array electrode in which a discharge in a cell associated therewith is to be extinguished, an erase signal cancelling pulse to each of said electrodes of said second array corresponding to cells associated with said selected first array electrode in which a discharge is to be maintained;

the voltage level of each of said write signal cancelling pulse and said erase signal cancelling pulse being substantially less than said second voltage level but sufficient to disable the said applied write signal from producing a discharge and the said applied erase signal from terminating a discharge, respectively; and applying sustain signals to all of said cells thereby to maintain said discharges in said selected cells.

18. A method as recited in claim 17, wherein said sustain signals comprise sustain pulses of approximately said second peak voltage level and the voltage level of each said write signal cancelling pulse and each said erase signal cancelling pulse is less than one-half of the said second peak voltage level.

19. A method as recited in claim 18, further comprising:

applying an erase signal of said second peak voltage level as a narrow width pulse capable of terminating the said discharges in the said cells associated with said first array electrode; and applying each said erase signal cancelling pulse, having said voltage level substantially less than said second voltage level, as a pulse of substantially greater pulse width than said erase signal pulse width.

20. A method as recited in claim 19, wherein said pulse width of said erase signal cancelling pulse is substantially the same as the pulse width of each of said write and sustain signals.

21. A method as recited in claim 20, wherein the voltage level of each said erase signal cancelling pulse is no greater than one-third of the voltage level of the sustain signal pulses.

* * * * *

UNITED STATES PATENT AND TRADEMARK OFFICE

CERTIFICATE OF CORRECTION

PATENT NO. : 4,684,849

DATED : AUGUST 4, 1987

INVENTOR(S) : AKIRA OTSUKA ET AL.

It is certified that error appears in the above-identified patent and that said Letters Patent is hereby corrected as shown below:

Col. 5, line 64, "Yi" should be --$Y_i$--.

Col. 6, line 62, "4(d)" should be --4(d);--.

Signed and Sealed this

Twenty-second Day of March, 1988

*Attest:*

*Attesting Officer*

DONALD J. QUIGG

*Commissioner of Patents and Trademarks*